US005333835A

United States Patent [19]

Smith et al.

[11] Patent Number: 5,333,835

[45] Date of Patent: Aug. 2, 1994

[54] ELECTRIC MOTOR DRIVEN AIR VALVE

[75] Inventors: Ronald R. Smith, Indianapolis; Richard D. Foreman, Connersville; Todd S. Graf, New Castle, all of Ind.; Joseph D. Redden, Waco, Tex.

[73] Assignee: American Standard Inc., New York, N.Y.

[21] Appl. No.: 95,889

[22] Filed: Jul. 22, 1993

[51] Int. Cl.[5] ..... F16K 31/04

[52] U.S. Cl. ..... 251/129.12; 251/129.11; 137/554; 454/334

[58] Field of Search ..... 251/129.12, 129.11; 137/554; 454/334

[56] References Cited

U.S. PATENT DOCUMENTS 4,082,114 4/1978 Hantke et al. .
4,775,133 10/1988 Ring et al. .
4,800,804 1/1989 Symington .
4,884,590 12/1989 Eber et al. .

*Primary Examiner*—Arnold Rosenthal
*Attorney, Agent, or Firm*—William J. Beres; William O'Driscoll; Peter D. Ferguson

[57] ABSTRACT

A valve for use in an air distribution system has an inlet member for the axial flow of air therethrough along a central axis. A downstream portion of the inlet tapers outwardly in the downstream direction. Support structure is presented from which an extension projects downstream along the axis of the inlet. A damper for controlling air flow through the inlet defines an aperture penetrated by the support structure extension and a second aperture radially displaced from the first aperture. A motor is attached to the damper and is directly coupled to the support structure extension. The motor selectively positions the damper along the support structure extension between a downstream open position and an upstream closed position.

4 Claims, 5 Drawing Sheets

FIG. 7
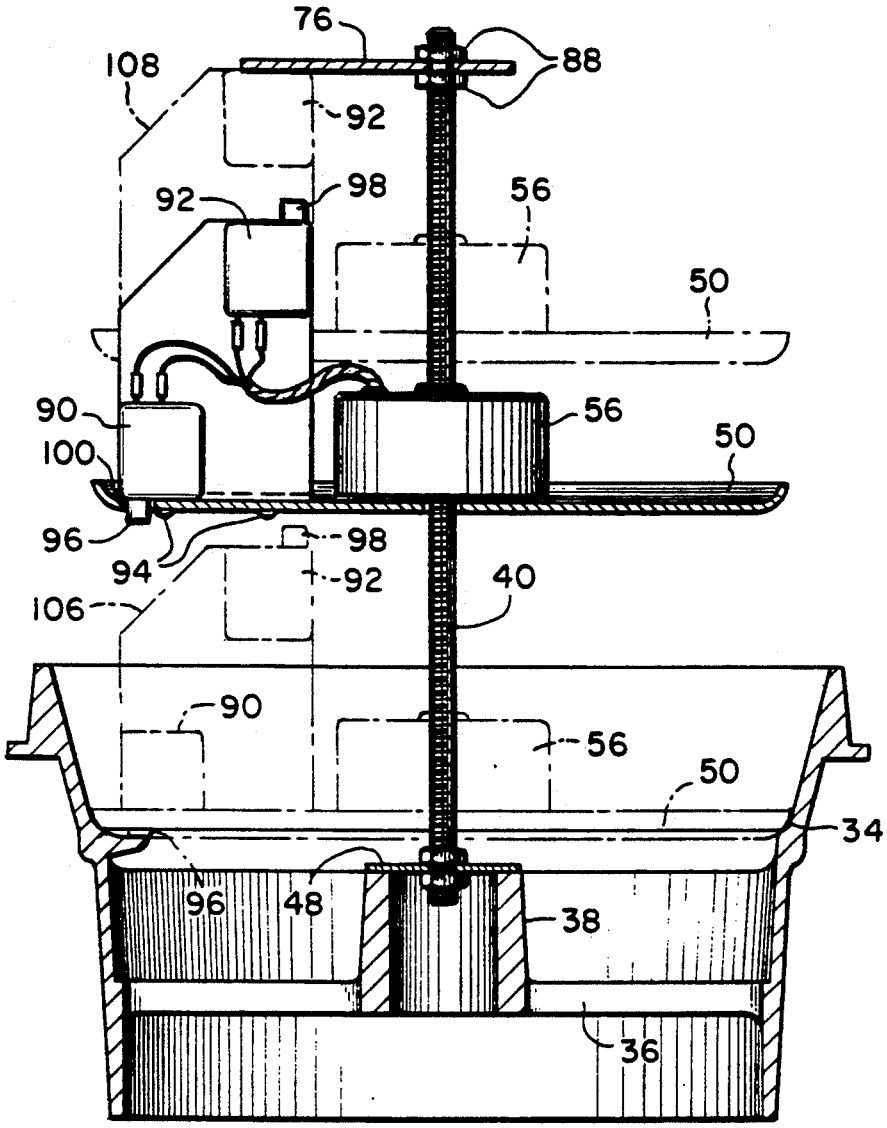
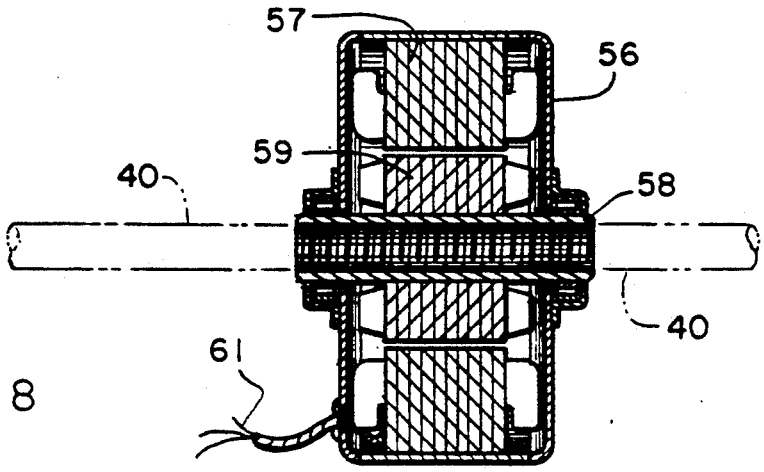
FIG. 8

ELECTRIC MOTOR DRIVEN AIR VALVE

Technical Field

The present invention relates to an air distribution system wherein the volume of conditioned air supplied to a zone is varied in order to control temperature within the zone. More particularly it relates to a motor driven air valve.

BACKGROUND OF THE INVENTION

Variable air volume (VAV) ventilation systems provide conditioned air from a central source for distribution to various zones within a building via a network of ducts. The amount of heating and cooling provided to the various zones is controlled by varying the volume of conditioned air provided to each zone. Since heating and cooling requirements vary from zone to zone and within individual zones depending upon factors such as solar load and the nature of zone usage, it is necessary that the amount of conditioned air supplied to a zone in response to local demand be selectively controlled.

In a variable air volume system, the selective delivery of conditioned air to a zone is accomplished through the association of an air distribution box with each zone. Such distribution boxes typically include a supply plenum and one or more air outlets in flow communication with the zone. Additionally, each box has a valve for controllably varying the volume of air delivered to its plenum and to the zone. Such air valves are thermostatically controlled so as to supply the volume of conditioned air, typically through a room diffuser, necessary to maintain or achieve a selected zone temperature.

The use of electric motors for controlling the damper position in VAV air valves is known. Earlier types of electric motor driven air valves are disclosed in U.S. Pat. Nos. 4,082,114; 4,775,133 and 4,884,590, which are all assigned to the assignee of the present invention. The valve of the '114 patent includes a close-ended cylindrical portion downstream of the valve inlet in which a generally tubular member is disposed for movement axially of the valve housing. The size of a series of radial ports, and therefore the flow of air through the valve, is determined by the position of the valve member within the valve housing.

U.S. Pat. No. 4,775,133 discloses an electric motor driven air valve having a cylindrical inlet section and a physically moveable, spring biased backplate on which a drive motor is disposed. The inlet section defines a seating surface upstream of which a support grid is disposed. The spring loaded backplate is supported by a plurality of rods that extend downstream from the inlet section.

A damper assembly includes a splined rod which extends upstream of the damper and into a cooperating spline in the support grid. A threaded spindle extends downstream of the damper plate and is penetrated by a cooperatively threaded gear which is mounted for rotation on the backplate and operably coupled to the threaded spindle. The spring loading of the back plate prevents the binding of the damper drive train after the damper has been driven to the fully closed position.

The invention disclosed in the '590 patent is an air valve having a cylindrical inlet section which defines a seating surface upstream of a support grid. A fixed backplate, upon which a drive motor is mounted, is supported by a plurality of rods that extend downstream of the inlet section. The damper assembly includes a splined rod which extends upstream and into a cooperating spline in the support grid. A threaded spindle extends downstream of the damper plate through a threaded motor driven drive gear mounted on the backplate. A strain sensing device is employed in controlling the operation of the drive motor to prevent binding of the damper drive train on valve closure.

An alternative room air diffuser incorporating fire/smoke protection apparatus is disclosed in U.S. Pat. No. 4,800,804. The '804 apparatus, which combines the function of an air valve, a room diffuser and a smoke damper is relatively very complex and expensive. The drive mechanism consists of a motor and associated gear train. The gear train, associated axles and gear case necessitate upstream support structure and a plurality of guide posts and associated guide sleeves. The rod on which the damper rides and the plurality of guide posts are supported at both of their respective ends making a backplate and further associated support structure necessary.

The need for the support structure employed by conventional air dampers such as those referred to above results from the need to mount a relatively massive and/or sophisticated drive mechanism, consisting of a drive motor, gear train and supporting members, directly on a valve damper or on a backplate-like structure. With respect to the damper, compounding the problem caused by the disposition of the drive system on it is the fact that the drive systems are typically asymmetrically mounted and their weight creates a tilting moment in the damper or the need for a relatively substantial support structure to counteract the tilting moment. The damper will tend, otherwise, to bind on the guide structure as the damper translates on its central shaft.

The need continues to exist for an electric motor driven air valve, particularly adapted for use in VAV air distribution boxes upstream of a room air diffuser, which is relatively uncomplicated, lightweight, inexpensive of manufacture and easy to maintain yet which provides for precise control of the volume of air flowing through it to the distribution box it supplies and to the associated room diffuser.

SUMMARY OF THE INVENTION

It is an object of the present invention to provide an electric motor driven air valve assembly which is commercially practicable, employs relatively few components, is lightweight, is simple of construction yet which effectively and precisely accomplishes airflow modulation.

It is also an object of the present invention to provide an air valve assembly in which the damper and drive means are supported by the inlet section of the valve assembly, without recourse to substantial upstream support structure.

It is another object of the present invention to provide an electric motor driven air valve assembly wherein the motor is mounted on the damper and drives the damper directly, without recourse to a gear train.

It is still another object of the present invention to provide a motor drive for the air valve assembly that is symmetrically mounted and balanced with respect to the damper and its support structure.

These and other objects of the present invention, which will become apparent when the following Description of the Preferred Embodiment and attached drawing figures are considered, are accomplished by an electric motor driven air valve assembly having a cylindrical inlet for permitting the axial, essentially unobstructed flow of air therethrough. The inlet includes support structure having an elongated extension member projecting axially downstream from it in a cantilevered fashion.

The extension member penetrates and supports a damper which has a periphery that presents a sealing surface which engages a sealing surface defined by the inlet structure. A drive motor is fixedly mounted on the damper and engages the downstream projecting extension member directly and without recourse to a gear train. A guide rod is affixed at one end to the inlet structure and extends downstream thereof parallel to the extension member. The guide rod penetrates and is slidably engaged in a second aperture in the damper by which damper rotation is resisted resulting in the selective positioning of the damper on the support structure extension by drive motor operation.

BRIEF DESCRIPTION OF THE DRAWINGS

FIG. 7 is a cross sectional view taken along line 7—7 of FIG. 4, illustrating the alternate embodiment of the air valve of the present invention in a partially open position with phantom lines depicting the fully open and fully closed positions.

FIG. 8 is a cross sectional view, taken along lines 8—8 of FIG. 1, of the drive motor of the present invention and its engagement with the extension member.

DESCRIPTION OF THE PREFERRED EMBODIMENT

Figure 2:
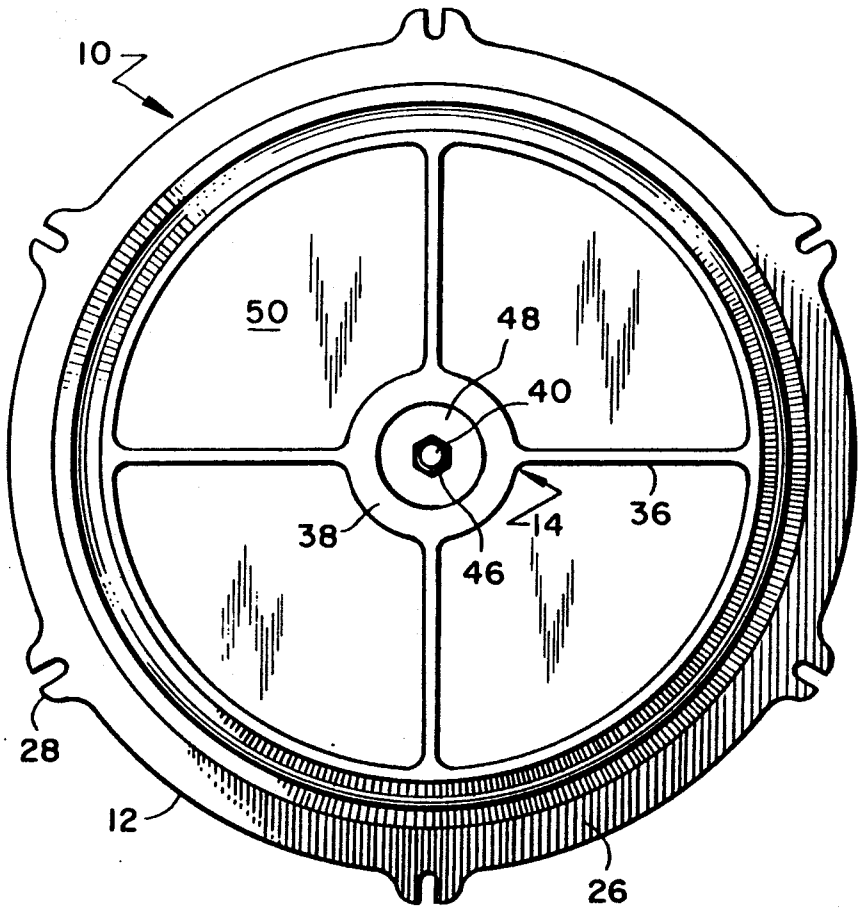
FIG. 2 is a view of the air valve of the present invention as viewed from upstream of the valve.
Figure 1:
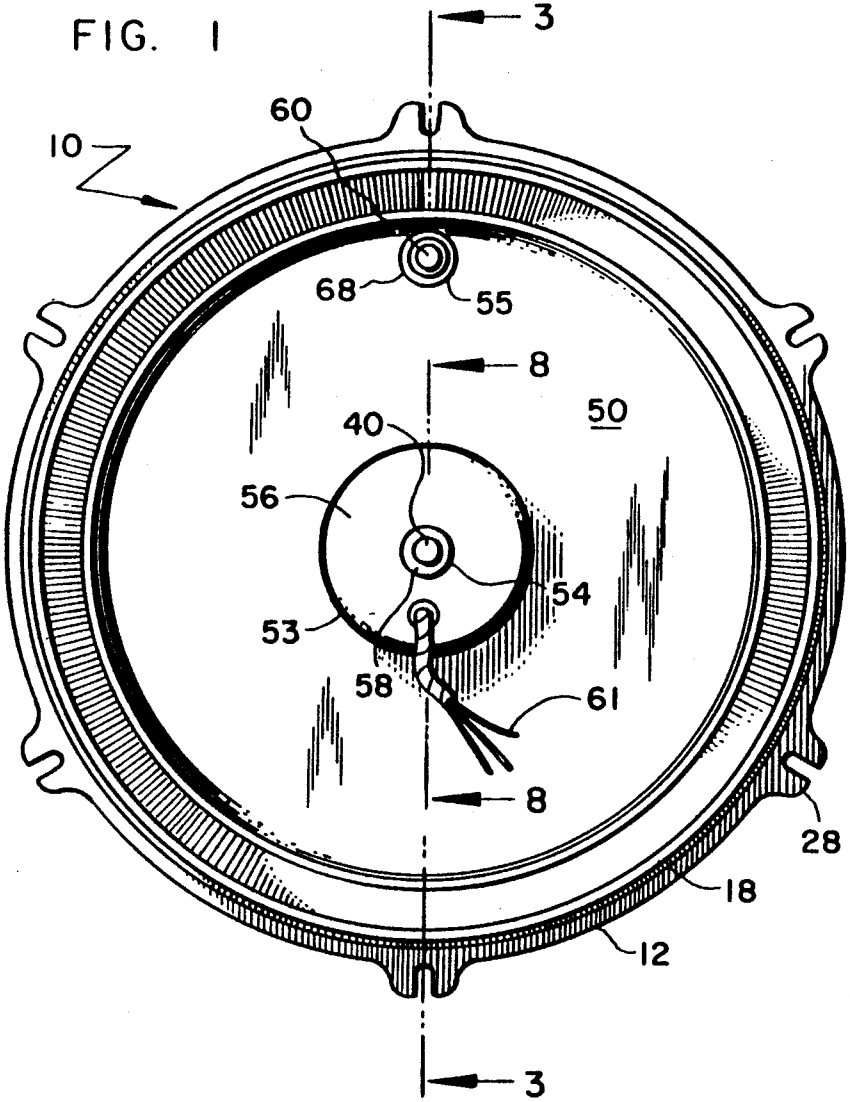
FIG. 1 is a view of the air valve of the present invention as viewed from downstream of the valve.
Figure 3:
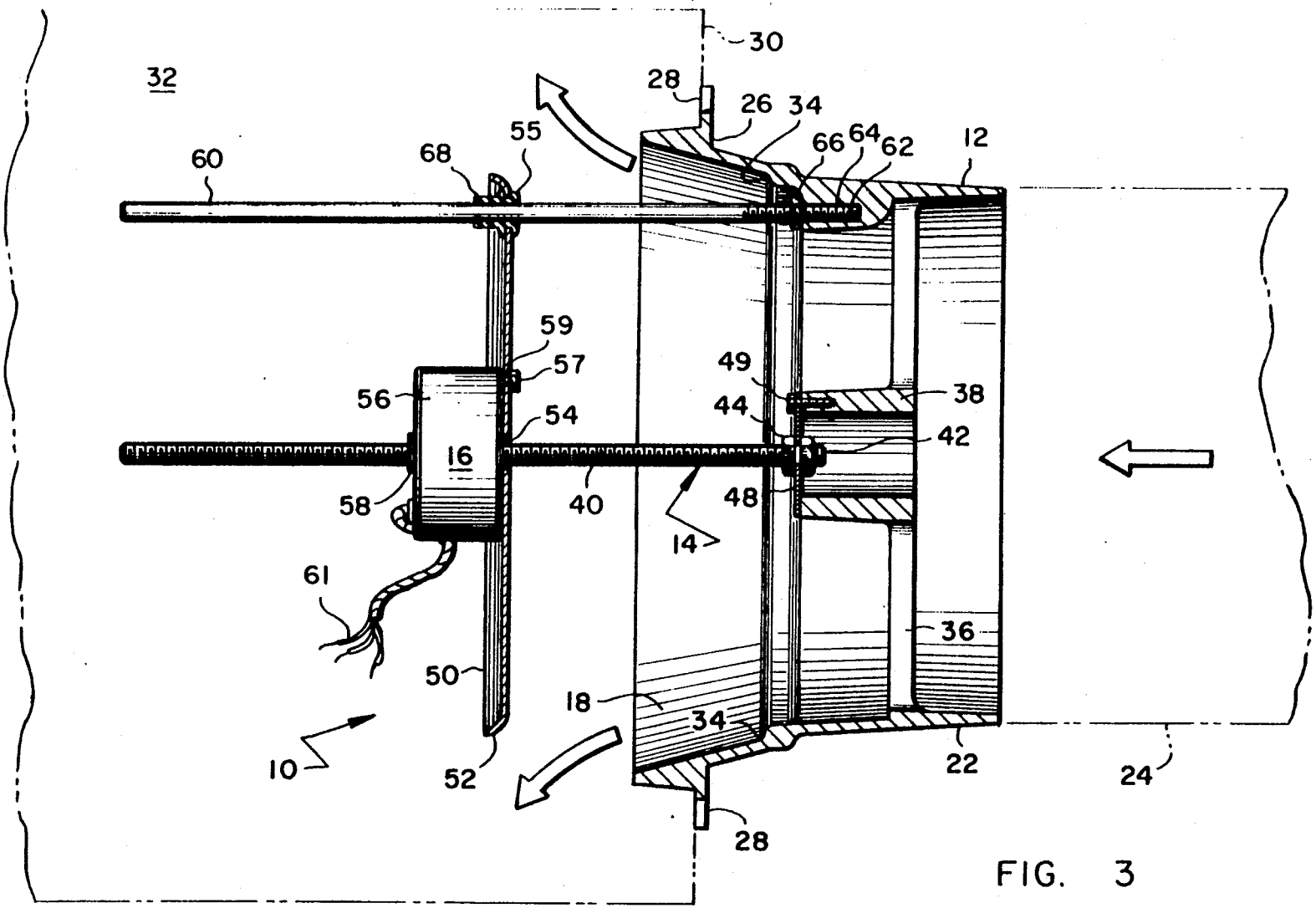
FIG. 3 is a cross sectional view taken along line 3—3 of FIG. 1, illustrating the preferred embodiment of the air valve of the present invention in a partially open position.
Figure 5:
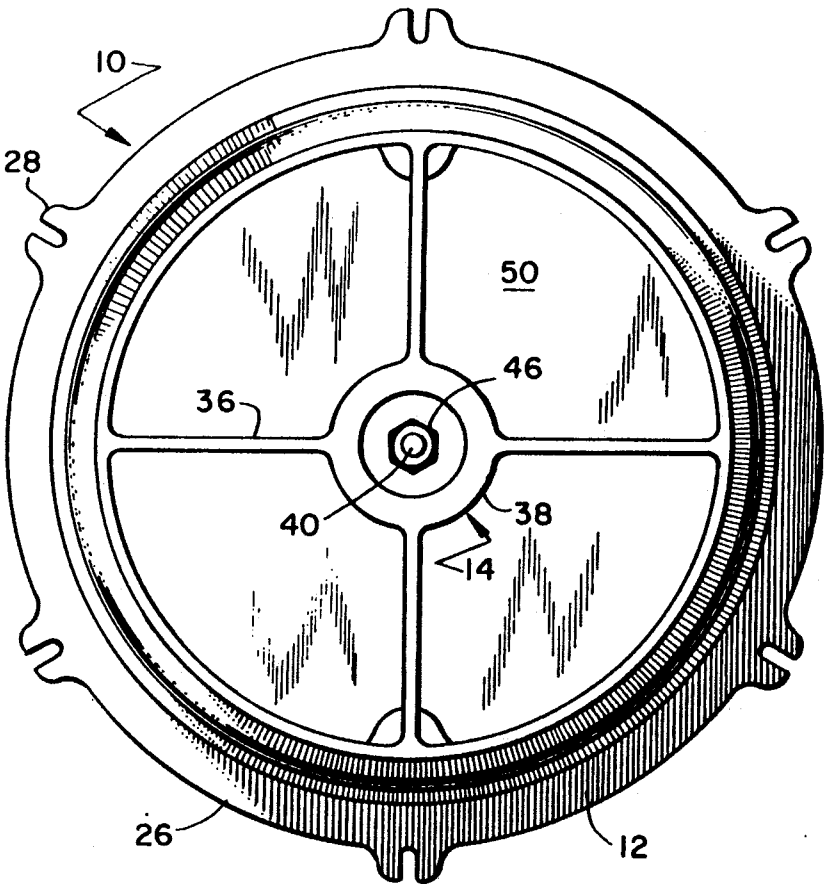
FIG. 5 is a view of the alternate embodiment of the air valve depicted in FIG. 4 as viewed from upstream of the valve.
Figure 4:
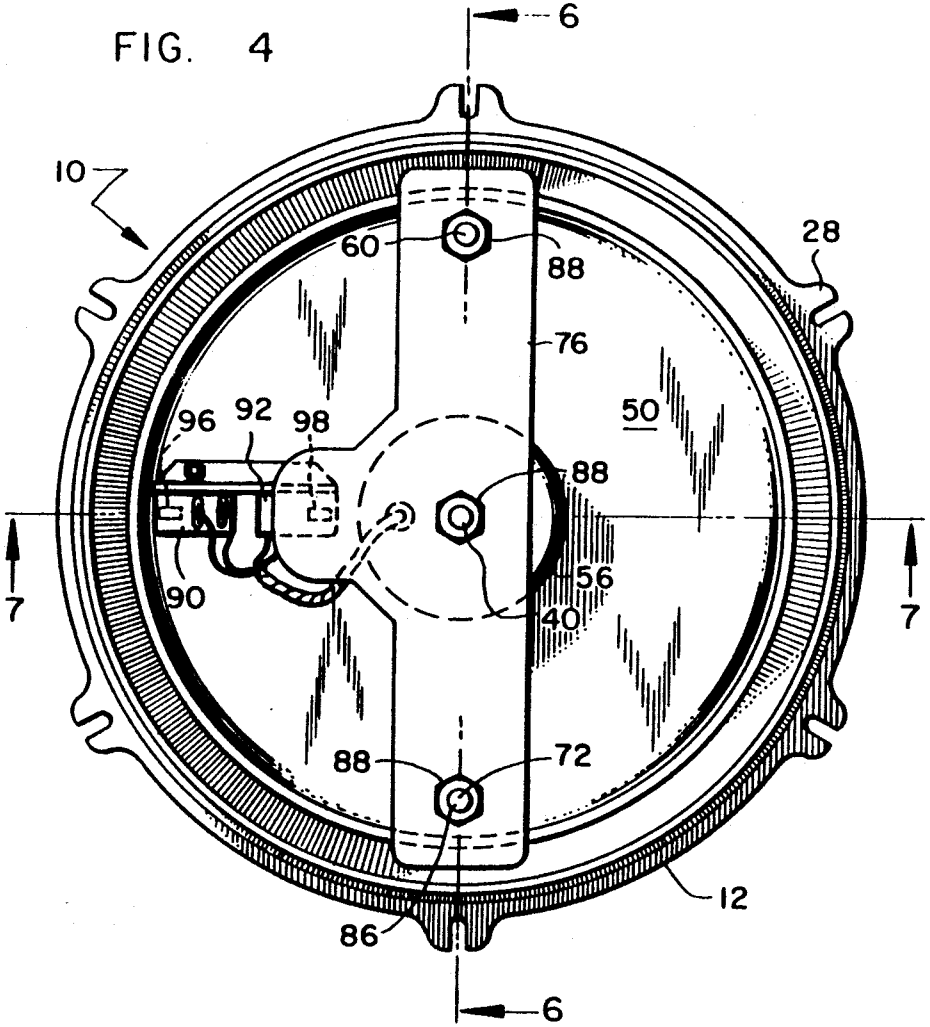
FIG. 4 is a view of an alternate embodiment of the air valve of the present invention in which a stiffening bracket and dual guide rods are employed, as viewed from downstream of the valve.
Figure 6:
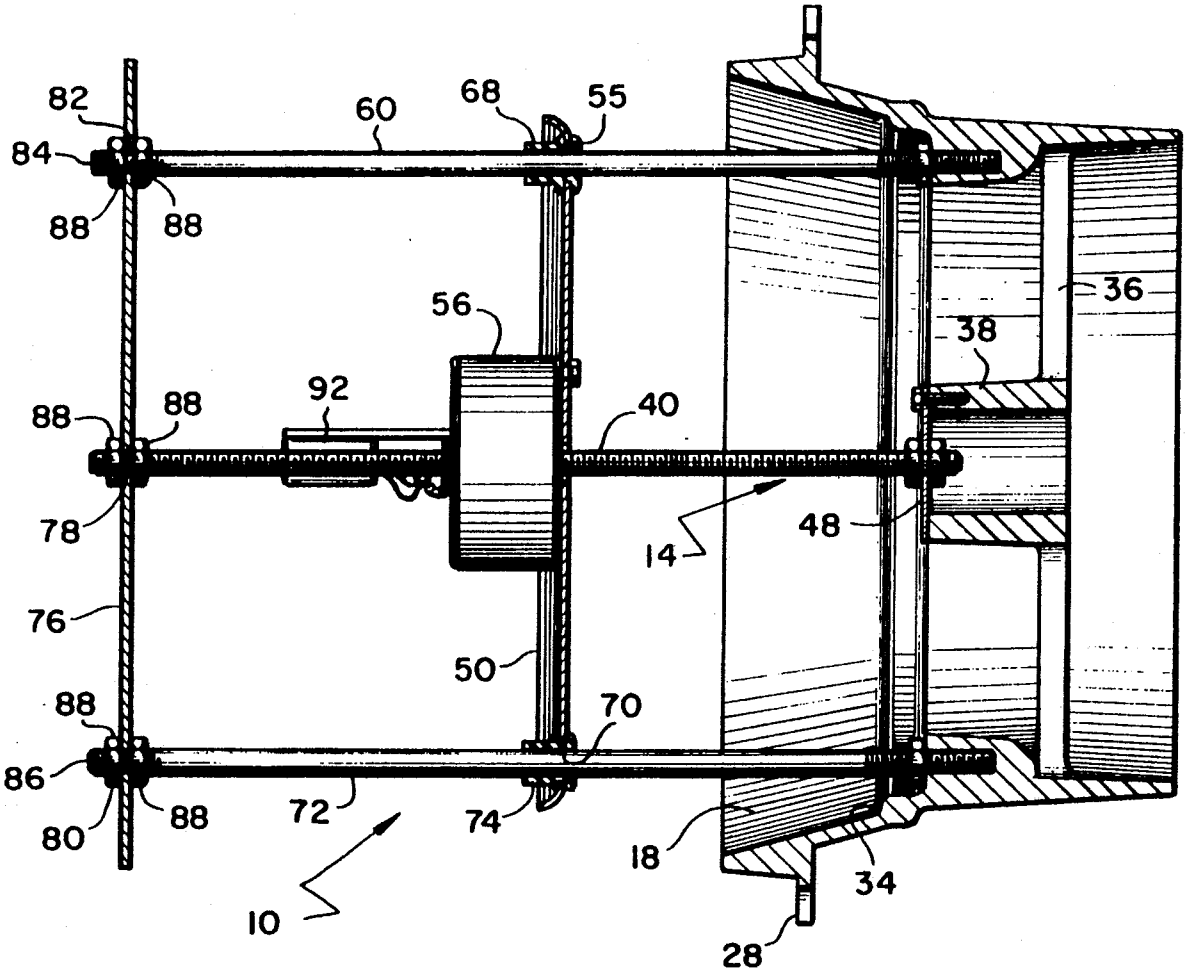
FIG. 6 is a sectional view taken along line 6-6 of FIG. 4, illustrating the alternate embodiment of the air valve of the present invention in a partially open position.

Referring concurrently to FIGS. 1-3, air valve assembly 10 is comprised of three primary sections, a preferably die cast, tubular air inlet section 12, downstream extending support structure 14, and damper assembly 16. The air passage defined by inlet section 12 has an outwardly flared downstream portion 18. Damper assembly 16, as will further be discussed, is supported for movement axially of the longitudinal axis of inlet section 12 by support structure 14.

Inlet section 12 has an upstream end surface 22 which is configured for engagement with a building air supply duct 24, illustrated in phantom in FIG. 3. Inlet section 12 also has a radially extending flange 26 at its downstream end from which a series of lugs 28 extend so as to permit the attachment and mounting of the valve assembly, such as by means of sheet metal screws (not shown), to an air distribution box 30. Air distribution box 30, shown in phantom in FIG. 3, defines a plenum 32 by which one or more room air diffusers may be supplied. The volume of air flowing into the plenum 32 is controlled in accordance with the position of damper assembly 16 with respect to inlet section 12.

Downstream portion 18 of inlet section 12 is outwardly flared which, together with the remainder of the inlet section, creates a venturi-like effect thereby enhancing both the flow and noise characteristics of the valve assembly. Downstream portion 18 also defines a generally annular seating surface 34 in its interior. The flare of discharge portion 18 commences and extends radially outwardly therefrom.

Support structure 14 includes a preferably integrally formed spider-like grid 36 in inlet section 12. Grid 36 is configured to present minimum resistance and disruption to air flowing through body section 12 consistent with the strength requirements. In the embodiment shown, grid 36 is comprised of four relatively slender and aerodynamically shaped legs which provide the necessary support without adversely affecting air flow through body section 12 from a flow or noise standpoint. More or fewer legs may be employed depending on the size of a particular valve assembly.

Support grid 36 presents a hub 38 that defines a central aperture. The central aperture is designed to receive threaded damper support extension member 40 which is a threaded rod that extends downstream of inlet section 12. Extension member 40 is preferably located along the axis of inlet section 12 and is rigidly attached at hub 38 to support grid 36.

First end 42 of extension 40 is held in place by lock nuts 44, 46 which are threaded onto extension 40 and located one on either side of web 48 of support grid 36. In the embodiment shown, web 48 is constructed of rigid sheet metal which is affixed to hub 38 by a plurality of threaded fasteners 49. It is understood that web 48 could be cast integral with hub 38 and that extension 40 could otherwise be fixedly attached to the support grid.

Lock nuts 44, 46 are worked against each other in locking engagement with web 48 to rigidly hold extension member 40 in place in the central aperture of hub 38. To ensure that lock nuts 44, 46 remain tight over extended periods of use, it is desirable that lock nuts 44, 46 have an integral locking means, such as a nylon inner liner that is deformed in the process of threading the lock nuts 44, 46 and thereby forms a locking engagement with extension member 40.

Extension member 40 is cantilevered from and provides the primary support for damper assembly 16. In the preferred embodiment, the support of damper assembly 16 is accomplished without recourse to further support of extension member 40 other than as previously described at first end 42 thereof. Accordingly, extension member 40 must be rigid and of sufficient stiffness to bear the load of damper assembly 16 without appreciable deflection. For devices of the usual size of air valve 10, a metal rod of three-eights inch diameter is generally adequate.

Damper assembly 16 includes a damper plate 50 having a bidirectional drive motor 56, mounted thereon. Aperture 54 of damper plate 50 is penetrated by extension member 40 so that the damper may be freely transported upstream and downstream on the extension member by the operation of motor 56 in order to vary the volume of air flowing through inlet section 12. Damper 50 is an annular disk having an outer rim that presents a sealing lip 52 to annular seating surface 34 of inlet section 12 when damper 50 is in the fully closed position.

The diameter of axial aperture 54 of damper 50 is slightly greater than the diameter of extension 40, so that damper 50 is spaced apart from the extension. A second aperture 55 in damper 50 is radially displaced from axial aperture 54. Bidirectional drive motor 56 is rigidly mounted to damper 50, such as by one or more threaded fasteners 57, which pass through a mounting bore 59 in damper 50 and carry into drive motor 56.

The exterior of drive motor 56 is presented as a housing 53 which encloses the electrical components of the motor. Referring concurrently to FIG. 8, first winding or stator 57 is fixed within housing 53. A second winding or rotor 59 is rotatable within housing 53 and is electromotively coupled to the stator.

A central rotatable sleevelike member 58 the exterior of which is rigidly affixed to the rotor 59, is disposed in drive motor 56. The interior surface of member 58 is cooperatively threaded for engagement with the threads of extension member 40. Motor 56 therefore directly drives damper assembly 16 directly without recourse to a gears of a drive train of any other sort.

In the preferred embodiment, damper 50 and therefore housing 53 are prevented from rotating by the penetration of the damper by a guide rod 60. Rotation of threaded shaft 58 on extension member 40 by the operation of the motor causes damper 50 to move upstream or downstream of the inlet section in accordance with the direction of motor rotor rotation, due to the guide rod's prevention of damper rotation, so as to either close or open the air valve assembly as desired.

In the preferred embodiment, drive motor 56 is able to traverse essentially the full operating length of extension 40 from a fully closed position to the full open position in less than one minute. Power is supplied to drive motor 56 by leads 61, which are connected to an external source of electric power through a series of switches as will further be described.

Drive motor 56 is of a compact, symmetrical and lightweight design. Its weight is evenly distributed both across damper 50 and with respect to extension member 40 which penetrates the respective centers of both the damper and drive motor. Because of its balanced nature, damper assembly 16 is much less prone to binding during its movement on extension member 40. As a result, the support structure for the damper assembly can be reduced in substance. Further, the centered, internally threaded drive member 58 of motor 56, which directly engages extension 40, eliminates the need for a gear train so that the total mass mounted on damper 50 is substantially reduced which, in turn, reduces the requirement for support structure for the damper assembly as a whole.

Guide rod 60 is threaded at end 62 into the threads of a bore 64 in inlet section 12, is radially displaced from the axis of and extends parallel to extension member 40 to the same extent that second aperture 55 displaced from first aperture 54 of damper 50. Lock nut 66 it is threaded tightly against the surface of body section 12 to ensure that the guide rod is rigidly held in place.

In a preferred embodiment, a grommet 68 is inserted in second aperture 55 of damper 50. Grommet 68 has an internal diameter which is slightly greater than the outside diameter of guide rod 60 so that there is relatively close slidable engagement between the guide rod and grommet. Grommet 68 is preferably fabricated from a low friction, wear resistant thermoplastic material that is capable of closely slideably engaging guide rod 60 so as to resist the rotation of damper 50 as the damper assembly is driven toward and away from inlet section 12. The exterior surface of guide rod 60 may be polished in order to enhance the sliding engagement with grommet 68.

An alternative embodiment of the present invention is shown in FIGS. 4–7 which includes additions to the structure of the previously described embodiment. Corresponding components are annotated with like numbers in each of the drawing figures.

As is depicted in FIGS. 4–7, damper 50 defines a third aperture 70 that is radially displaced from aperture 54 and diametrically opposite of second aperture 55 the same distance as second aperture 55 is displaced from axial aperture 54. A second guide rod 72 is affixed to inlet section 12 in a manner similar to that of guide rod 60 and projects slidably through aperture 70 inside of second grommet 74 which is of similar construction to grommet 68. Second guide rod 72 is constructed similarly to and preferably interchangeable with guide rod 60.

The embodiment of FIGS. 4–7 includes a stiffener 76 which is a thin but rigid metallic strap. The primary purpose of stiffener 76 is to increase the structural rigidly of the various members supporting damper assembly 14 so as to maintain generally parallel alignment between the extension member and elongated first and second guide rods.

In the embodiment shown, stiffener 76 defines three bores. The first bore is central bore 78 while diametrically opposite peripheral bores 80 and 82 are located on either side thereof and are displaced from central bore 78 a distance equal to the distance first guide rod 60 and second guide rod 72 are displaced from extension member 40. Accordingly, extension member 40 projects through central bore 78, guide rod 60 projects through peripheral bore 82, and second guide rod 72 projects through peripheral bore 80. Second end 84 of guide rod 60 and second end 86 of second guide rod 72, like extension member 40, are threaded and lock nuts 88 are utilized in pairs to firmly secure stiffener 76 to extension member 40, first guide rod 60 and second guide rod 72.

Limit switches 90, 92 move with damper 50 and provide one mechanism to turn off drive motor 56 when damper 50 reaches its fully opened or closed positions on extension member 40. Limit switches 90, 92 are preferably preassembled as a unit which is affixed to damper 50 by threaded fasteners 94. Limit switches 90, 92 have actuators 96, 98 that are spring biased so as to generate an output signal which interrupts power to motor 56 when depressed such as by contact with a fixed surface.

Actuator 96 of limit switch 90 is mounted to project through a fourth aperture 100 in damper 50°. When actuator 96 is depressed, a signal is generated that is utilized to deactivate drive motor 56 with respect to travel toward inlet section 12. Actuator 96 is located such that, when damper 50 is fully closed, actuator 96 is depressed by its contact with the structure of inlet section 12. Similarly, depression of actuator 98 generates a signal that is utilized to deactivate drive motor 56 with respect to further travel away from inlet section 12. Actuator 98 is located such that when damper 50 is fully open, it is depressed by its contact with the structure of stiffener 76.

OPERATION

In operation, the position of damper 50 of valve assembly 10 at any given time is determinative of the volume of air that flows into plenum 32 of the air distribution box 30. It will be appreciated that the volume of air flowing into plenum 32 is controllably varied by the selective positioning of damper assembly 16 with respect to seating surface 34 of inlet section 12.

The demand for conditioned air in the space with which plenum 32 communicates through a room diffuser decreases as the space temperature approaches a desired temperature such as, for example, the temperature that is set on a room thermostat. Responsive thereto, drive motor 56 is controllably energized to drive damper 50 in a direction toward seating surface 34 of inlet section 12, thereby reducing airflow to the distribution box.

Damper 50 and drive motor 56 are restrained from rotating by guide rod 60 (and second guide rod 72, in the embodiment of FIGS. 4–7). Guide rod 60 resists the torque developed by drive motor 56, thus channeling the motor torque into the axial motion of damper assembly 16 in the desired direction on extension member 40.

If the demand for conditioned air decreases sufficiently, drive motor 56 drives damper assembly 16 toward the seating surface 34 to the extent that lip 62 of damper 50 is urged into abutment with seating surface 34 of body section 12 thereby entirely shutting off the flow of air into distribution box 30. This condition is depicted by the first set of phantom lines 106 in FIG. 7. As shown, actuator 96 of limit switch 90 is depressed and accordingly, a deactivation signal has been sent to drive motor 56.

When air flow is once again called for through air valve assembly 10, drive motor 56 is energized in a direction which causes damper assembly 16 to move away from seating surface 34. If maximum air flow is called for, drive motor 56 causes the continued motion of damper assembly 16 in the downstream direction into its fully opened position as is depicted by phantom lines 108 in FIG. 7. As indicated in this depiction, actuator 98 of limit switch 92 is depressed by its abutment against stiffener 76 and a deactivation signal has been sent shutting off drive motor 56.

It will be appreciated, given the teachings herein, that modifications may be made to the present invention which do not depart from the spirit of the invention. Therefore, the scope of the present invention is to be limited only in accordance with the language of the claims which follow.

We claim:

1. An air valve comprising:

a generally cylindrical inlet section, said inlet section defining a seating surface;

support means cantilevered from said inlet section, said support means including a threaded rod extending downstream form said inlet section;

a damper assembly, including a damper plate and a bidirectional electric motor, said motor including a rotatable portion, both said damper plate and said rotatable portion of said motor being penetrated by said threaded rod and said damper plate being mounted to said motor, the weights of said motor and said damper plate being generally symmetrically distributed with respect to the axis of said threaded rod and said damper plate defining a seating surface configured to cooperatively seat on said inlet section seating surface, said damper plate positionable between (i) a fully closed position in abutment with said seating surface and (ii) a fully open position downstream of said inlet section and out of the path of air flowing into and through said inlet section, said motor selectively bidirectionally positioning said damper assembly on said threaded rod;

a first and a second guide rod, each penetrating said damper plate and projecting generally parallel to said threaded rod, said first and said second guide rods restraining the rotation of said damper plate so that torque created by the rotation of the rotor of said motor is transmitted through said rotatable portion of said motor to the threads of said threaded rod so as to cause the axial movement of said damper plate on said threaded rod;

a stiffener member for maintaining said first and said second guide rods and said threaded rod generally parallel; and switch means operable to (i) de-energize said motor when said damper plate moves into said fully closed position by contact of said switch means with said inlet section and (ii) to de-energize said motor when said damper plate moves into said fully open position by contact of said switch means with said stiffener member.

2. A valve for modulating airflow comprising:

a cylindrical inlet section, said inlet section defining a seating surface;

a damper plate, said damper plate having a seating surface configured for sealing engagement with said seating surface of said inlet, said damper plate being retractable downstream and entirely out of said inlet section;

a threaded rod, generally co-axial with and extending downstream of said inlet section with respect to the direction of said airflow through said valve, for supporting said damper plate for axial movement with respect to said inlet section;

a bidirectional motor, said motor mounted to said damper plate nd including a rotatable threaded portion, said damper plate and said motor being penetrated by said threaded rod, the weight of said motor and said damper plate being generally evenly distributed with respect tot he axis of said threaded rod and said threaded portion of said bidirectional motor being in direct engagement with said threaded rod;

means, extending downstream of said inlet section and generally parallel to said threaded rod, for preventing the rotation of said damper plate when said motor is energized, said means for preventing rotation causing the torque created by the operation of said motor to be transmitted through said rotatable motor portion to the threads of said rod thereby causing the movement of said motor and said damper plate on said threaded rod axially of said inlet section; and switch means for de-energizing said motor when said valve moves into a fully open or a fully closed position, said switch means being operable to de-energize said motor through contact with said inlet section as said damper plate moves into said fully closed position and to de-energize said motor through contact with said means for maintaining a generally parallel relationship as said damper plate moves into said fully open position.

3. The air valve according to claim 2 wherein said means for restraining rotation comprises a first and a second guide rod.

4. An air valve for use in an air distribution system having at least one duct for directing the flow of air therethrough into a space to be ventilated, said air valve comprising:

a generally tubular inlet member defining a central axis of said air valve, said tubular member presenting an upstream and adapted for operable engagement with said duct and a downstream end defining a seating surface, said downstream end having a discharge portion oriented in said downstream direction and presenting a radially outwardly flared, venturi-like mouth;

support structure, upstream of said seating surface of said inlet member, operably carried by said inlet member and including an elongated support member, said elongated support member being a threaded rod having a supported end and an opposed free end, said support structure further including means for fixedly mounting said elongated support member at said supported end in a cantilevered manner along the central axis of said air valve, said supported end of said support member being attracted to said inlet member and said free end extending downstream therefrom with respect to the direction of airflow through said valve;

a damper assembly, including a moveable damper for controlling the flow of air through said valve, said damper defining an aperture generally in its center and first and second guide rod apertures, radially spaced from said center damper aperture, said aperture in said enter of said damper being penetrated by said threaded rod;

a bidirectional motor attached to said damper and having an internal threaded hollow shaft in cooperative engagement with said threaded rod, said motor and said damper being symmetrically mounted about said threaded rod so that the weight of said damper and said motor is symmetrically distributed with respect to the axis of said rod, said motor driving said damper between a closed position wherein said damper is seated on said seating surface so as to block the flow of air through said inlet member and an open position wherein said damper is positioned downstream of said inlet member so that the flow of air therethrough is essentially unobstructed by said damper;

first and second elongated guide rods, fixedly attached to said inlet member in a cantilevered manner and radially spaced from and generally parallel to said threaded rod, said first and said second guide rods being operably coupled to said damper assembly so as to maintain a constant radial orientation of said damper relative to said inlet member as said damper moves between said open and said closed positions, said first and said second guide rods penetrating said first and second guide rod apertures and said damper plate and being in slideable engagement therewith;

means for maintaining the generally parallel alignment of said extension member and said elongated guide rods; and switch means operable to de-energize said motor on contact with said inlet member as said valve moves into said fully closed position and to de-energize said motor on contact with said means for maintaining generally parallel alignment as said damper moves into said fully open position.

* * * * *